US006467096B1

(12) United States Patent
Coluccio

(10) Patent No.: US 6,467,096 B1
(45) Date of Patent: Oct. 22, 2002

(54) SIZE ADJUSTMENT MECHANISM FOR HEADWEAR

(75) Inventor: Julie Coluccio, Seattle, WA (US)

(73) Assignee: International News, Inc., Kent, WA (US)

( * ) Notice: Subject to any disclaimer, the term of this patent is extended or adjusted under 35 U.S.C. 154(b) by 0 days.

(21) Appl. No.: 09/864,875

(22) Filed: May 25, 2001

(51) Int. Cl.[7] ..... A42B 1/00

(52) U.S. Cl. ..... 2/195.2; 2/175.1; 2/171; 2/183

(58) Field of Search ..... 2/195.2, 175.1, 2/171, 175.4, 171.5, 171.7, 171.8, 183, 202, 204, 209.11, 209.12, 195.1, 195.3, 195.4, 195.7

(56) References Cited

U.S. PATENT DOCUMENTS

| | | | |
|---|---|---|---|
| 1,702,427 | A | 2/1929 | Blum |
| 1,992,285 | A | 2/1935 | Blum |
| D160,404 | S | 10/1950 | Levine |
| 2,869,137 | A | 1/1959 | Scherz |
| 3,016,545 | A | 1/1962 | Donahue |
| 4,845,782 | A | 7/1989 | Gregg |
| 5,170,509 | A | 12/1992 | Leopold |
| 5,197,292 | A | 3/1993 | McPherson |
| 5,239,704 | A | 8/1993 | Cornelio et al. |
| D340,344 | S | 10/1993 | McPherson |
| 5,450,629 | A | 9/1995 | Gilstrap |
| D375,188 | S | 11/1996 | Nickerson |
| 5,694,647 | A | 12/1997 | Crickmore |
| 5,802,617 | A | 9/1998 | Boden |
| D406,687 | S | 3/1999 | Thorpe |
| 6,094,749 | A | 8/2000 | Proctor |

*Primary Examiner*—Gloria M. Hale
(74) *Attorney, Agent, or Firm*—Liniak, Berenato, Longacre & White, LLC

(57) ABSTRACT

A baseball type cap comprising a hemispherical shell defining an opening for reception of a head of a wearer, and a size adjustment mechanism mounted to the shell for infinitely adjusting a size of the cap. The size adjustment mechanism includes a flexible drawstring slidably disposed within a channel formed along a peripheral edge of the shell, and a shiftable clamping slide adjustably mounted to the drawstring. A middle portion of the drawstring extends from the channel through a pair of holes therein and passes beneath a retaining loop formed on an outer peripheral surface of the cap shell, forming a closed adjusting loop. The clamping slide is operably attached to the adjusting loop for controlling the size of the adjusting loop, thus operatively adjusting an effective perimeter of the peripheral edge of the cap shell that defines a size of the headwear.

4 Claims, 3 Drawing Sheets

SIZE ADJUSTMENT MECHANISM FOR HEADWEAR

BACKGROUND OF THE INVENTION

1. Field of the Invention

The present invention relates to headwear, and more particularly to an improved baseball-type cap including a size adjustment mechanism in the form of a looped drawstring, which is secured to the cap above its rim.

2. Description of the Prior Art

Headwear pieces have been used for many years and are found in many shapes and sizes. The headwear pieces are used as sunshades, to repel the weather, and often simply for aesthetic purposes. The most popular headwear is the baseball-style cap. The baseball cap typically comprises a substantially hemispherical shell and a visor attached to an edge of the shell at the front of the cap to shade the eyes of the user. The shell is typically made of a flexible material, such as fabric. The visor is commonly made of a somewhat rigid material typically covered with the material used to form the shell, and extends substantially perpendicularly away from the shell to provide shade for the user's face. Typically, such baseball-style caps have an adjustment system along the edge of the shell to change a circumferential size of the shell periphery to match that of the wearer's head. Attempts have been made to vary the cap opening size of caps in general over the years.

Predominantly in recent years, the size adjustment of headwear, and particularly baseball-style caps, have utilized overlying plastic strips fixed at one end to respective opposite sides of the hemispheric shell with respective strips carrying spaced projecting pegs and holes. However, the pegs, the holes and the plastic strips themselves are subject to breakage, while limiting the adjustability feature to the spacing between pegs and holes.

Another type of the size adjustment mechanism utilizes a pair of drawstrings and a clamping lock. Each of the drawstrings has a first end attached to a front section of the cap shell or to the visor, and a second end extending through a channel along a peripheral edge or brim of the shell and free falling from a rear section of the shell. The clamping lock grips the free falling second ends of the drawstrings in different adjusted positions. However, the free falling ends of the drawstrings are aesthetically not very pleasing, may pose a risk for safety of the wearer, and there is always a possibility that the clamping lock slides off the drawstrings.

Therefore, there is a need for a size adjustment mechanism for headwear that is simple, durable, esthetically pleasing and safe for the wearer.

SUMMARY OF THE INVENTION

The invention contemplates a novel and improved means for adjusting the head sizes of headwear. The present invention is applicable to various types of headwear, which may be of any style or embodiment.

One embodiment of the headwear is a baseball-style cap comprising a hemispherical shell defining an opening for reception of the head of a wearer, and a size adjustment mechanism mounted to the shell for infinitely adjusting the size of the cap. The size adjustment mechanism includes a flexible, elastic drawstring slidably disposed within a channel or sleeve formed along a-peripheral edge of the shell, and a shiftable clamping slide adjustably mounted to the drawstring. A portion of the drawstring extends from the channel through a pair of holes therein and passes beneath a retaining loop formed on an outer peripheral surface of the cap shell, forming an adjusting loop. The clamping slide is operably attached to the adjusting loop for controlling the size of the adjusting loop, thus operatively adjusting an effective perimeter of the peripheral edge of the cap shell that defines the size of the headwear.

Therefore, the size adjustment mechanism for headwear in accordance with the present invention provides a simple, durable, inexpensive, aesthetically pleasing and easily manipulated mechanism readily allowing infinite adjustment of the size of the headwear.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENTS

Figure 1:
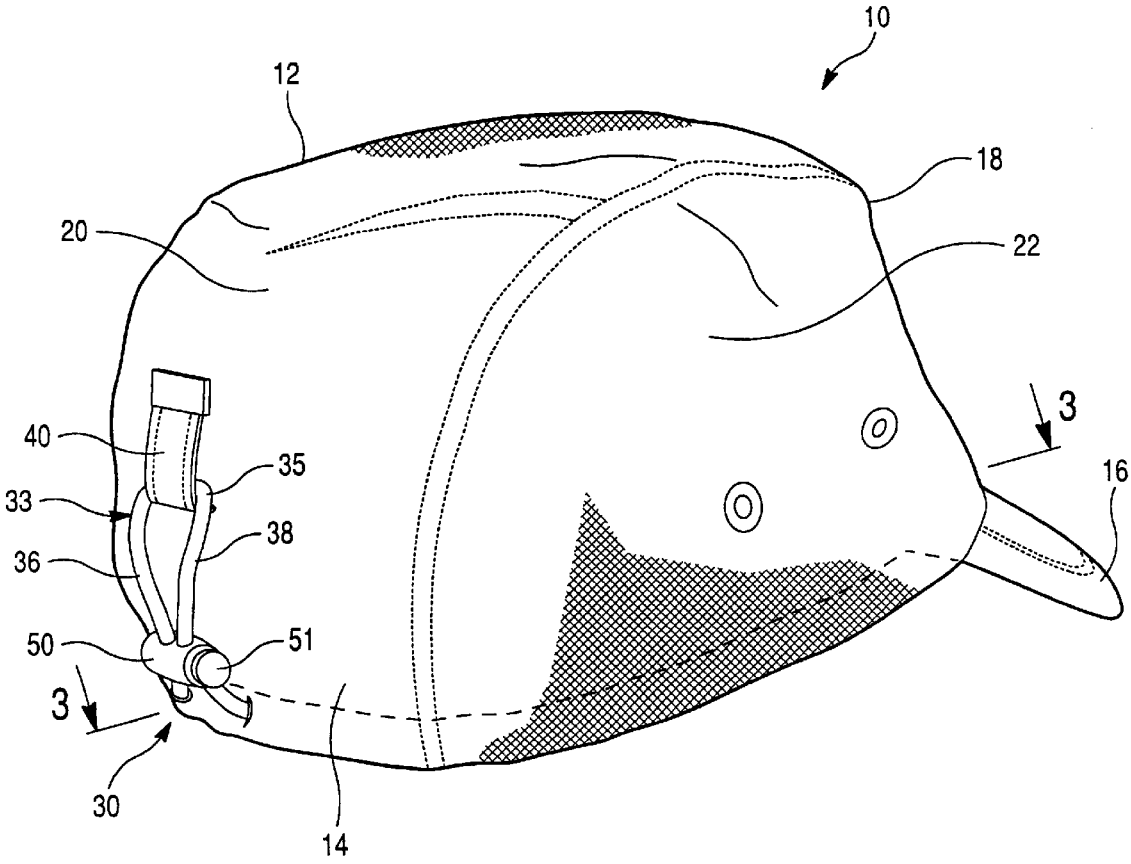
FIG. 1 is a perspective view of a baseball-style cap in accordance with the present invention.
Figure 2:
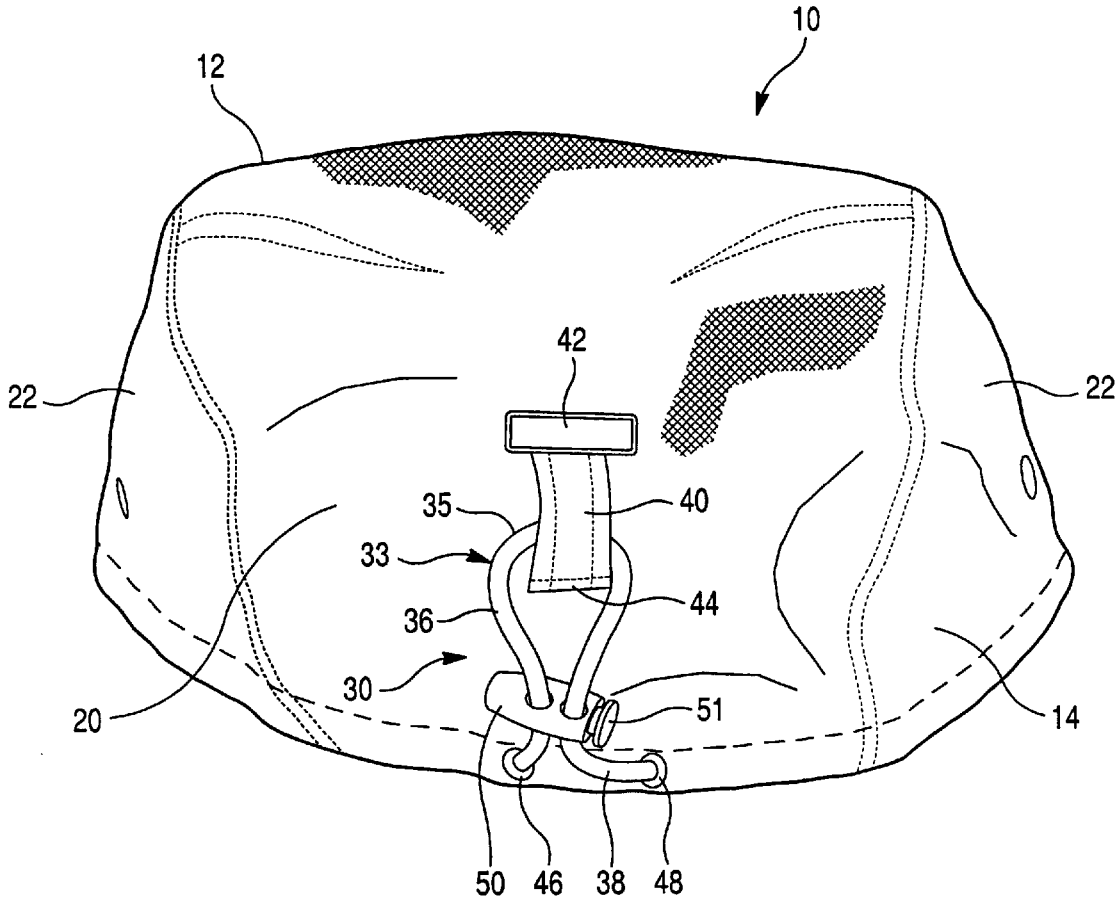
FIG. 2 is a rear elevational view of the baseball-style cap in accordance with the present invention.

The present invention is directed to headwear, such as a baseball-style cap indicated generally at 10, although not limited thereto. As best shown in FIGS. 1 and 2, the cap 10 comprises a shell 12 of generally hemispherical shape, a visor 16 affixed to the shell 12 to project forwardly therefrom, and a size adjustment mechanism 30 for infinitely adjusting the size of the cap 10. The term shell 12 refers to the portion of the headwear that covers the head of a wearer, regardless of the style of the headwear. The shell 12 includes a bottom portion 14 forming an opening for reception of the head of the wearer and defining a peripheral edge 15 around the opening. It should be appreciated by those skilled in the art that the perimeter of the peripheral edge 15 determines the size of the cap 10. In accordance with the present invention, the perimeter of the peripheral edge 15 is adjustable and enables the wearer to adjust the size of the cap 10.

The shell 12 further includes a front portion 18, a rear portion 20 and opposite side portions 22. Typically, the visor 16 is operably attached to the front portion 18 of the shell 12 along the peripheral edge 15, and extends outwardly over a wearer's face.

Figure 3:
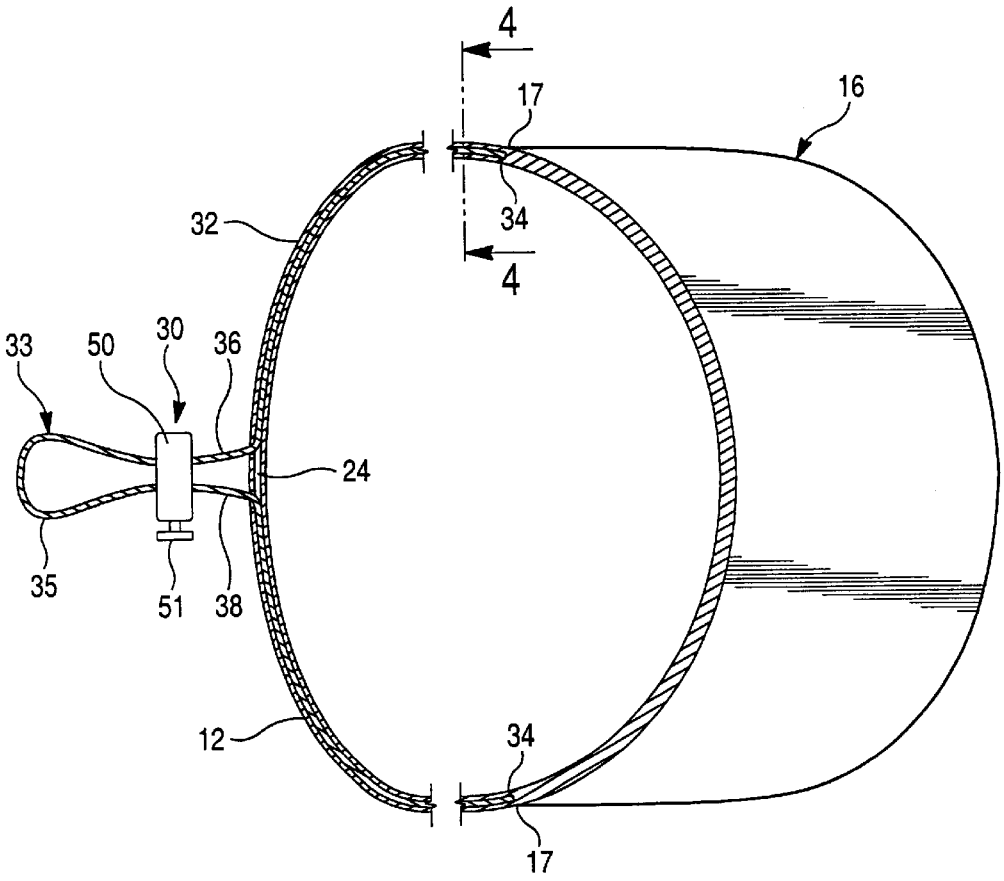
FIG. 3 is a fragmentary sectional view taken along line 3—3 of FIG. 1.
Figure 4:
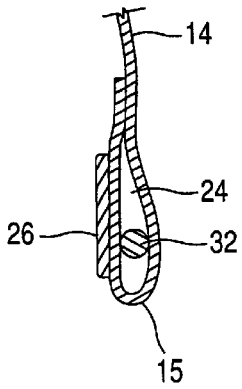
FIG. 4 is an enlarged sectional view taken along line 4—4 of FIG. 3.

Regarding the shell 12, the peripheral edge 15 is hemmed, defining a channel 24 extending around the entire peripheral edge 15 of the shell 12, as shown in FIGS. 3 and 4. A head liner 26 may be sewn or otherwise fixed along the peripheral edge 15 inside of the shell 12 to help provide a comfortable fit for the user, as shown in FIG. 4.

The size of the cap 10 of the present invention is infinitely adjustable to nearly any head size, because the size is adjusted continuously by use of the size adjustment mechanism 30. The size adjustment mechanism 30 comprises a flexible elastic drawstring 32 (or other elongated flexible element) slidingly attached to the bottom portion 14 of the shell 12. The drawstring 32 has a pair of opposite ends 34 operably attached to corresponding ends 17 of the visor 16, as illustrated in FIG. 3. Alternatively, the ends 34 of the drawstring 32 may be secured directly to the bottom portion 14 of the shell 12 by any appropriate means known to those skilled in the art.

In accordance with the preferred embodiment of the present invention, because the drawstring 32 is secured at its ends 34, it is slidably disposed within the channel 24 along the peripheral edge 15 of the shell 12 between where the ends 34 of the drawstring 32 are attached to the ends 17 of the visor 16, as shown in FIG. 3, forming a continuous loop along the peripheral edge 15 of the shell 12.

A portion of the drawstring 32 (preferably a middle portion of the drawstring), indicated generally at 33, extends from the channel 24 through a pair of holes therein, preferably defined by grommets 46 and 48, and passes beneath a retaining loop 40 provided for orienting the drawstring portion 33 substantially along an outer peripheral surface of the shell 12. The loop 40 prevents the middle portion 33 from hanging down beyond the bottom portion 14. The retaining loop 40 includes a substantially vertically oriented elongated strip of fabric having an upper end 42 and lower end 44 fixedly attached to, preferably, an outer peripheral surface of the rear portion 20 of the shell 12. Alternatively, the retaining loop 40 may be attached to other portions of the shell 12, such as side portion 22. The portion 33 of the drawstring 32 includes a first drawstring leg 36 and a second drawstring leg 38 extending between the retaining loop 40 and the grommets 46 and 48 respectively, as shown in FIGS. 2 and 3. Alternatively, only one hole in the channel 24 may be provided through which both drawstring legs 36 and 38 of the drawstring portion 33 extends from the channel 24.

Further in accordance with the present invention, the size adjustment mechanism 30 includes a shiftable clamping slide 50 that controls the size of the cap 10. The clamping slide 50 is provided for clamping the drawstring legs 36 and 38 in tight clamping engagement, and preventing relative movement thereof, thus forming the closed adjusting loop 35. The clamping slide 50 is of conventional type, well known in the art. The clamping slide 50 is operably attached to the first and second drawstring legs 36 and 38 and includes a casing having a pair of transverse holes through it and receiving a plunger with transverse apertures through which the first and second drawstring legs 36 and 38 of the drawstring pass in side-by-side spaced arrangement. A compression spring within the housing shifts the plunger axially relative to the housing, tending to move the plunger aperture and the housing holes out of registration to clamp the drawstring legs. The fastener can be released by pressing on plunger head 51 to shift the plunger so that the plunger aperture and the casing holes are moved into registration to release the grip on the drawstring legs 36 and 38 so that they can be moved through the clamping slide 50.

The position of the clamping slide 50 on the drawstring legs 36 and 38 defines a perimeter of the closed adjusting loop 35. By selectively positioning the clamping slide 50 along the first and the second drawstring legs 36 and 38, the perimeter of the adjusting loop 35 may be adjusted. It will be obvious to those skilled in the art that by changing the perimeter of the adjusting loop 35, the perimeter of the peripheral edge 15 that determines the size of the cap 10, is also adjusted, as the adjusting loop 35 is an integral part of the drawstring 32. In this relationship, the size adjustment mechanism 30 can act to operatively shorten the perimeter of the peripheral edge 15 of the shell 12, as is necessary to adjust the size of the cap 10. Alternatively, the size adjustment mechanism 30 can operatively lengthen the peripheral edge 15, thus increasing the effective size of the cap 10.

Therefore, the size adjustment mechanism for a headwear in accordance with the present invention represents a novel simple, inexpensive, durable and easily manipulated mechanism readily allowing infinite adjustment of the size of the headwear.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. An adjustable size headwear comprising a shell having a bottom portion defining an opening for reception of the head of a wearer, said bottom portion of said shell having a peripheral edge around said opening and said peripheral edge having an adjustable effective perimeter;

a size adjustment mechanism including a flexible drawstring slidably connected to said peripheral edge and a shiftable clamping slide adjustably mounted to said drawstring for forming a closed adjusting loop, said drawstring and said clamping slide cooperating to adjust the effective perimeter of said peripheral edge of said bottom portion of said shell defining a size of the headwear; and a retaining loop formed on an outer peripheral surface of said shell, wherein said portion of said drawstring passes beneath said retaining loop and forms said closed adjusting loop around said retaining loop.

2. An adjustable size headwear comprising:

a shell having a bottom portion defining an opening for reception of the head of a wearer, said bottom portion of said shell having a peripheral edge around said opening and said peripheral edge having an adjustable effective perimeter;

a size adjustment mechanism including a flexible drawstring slidably connected to said peripheral edge and a shiftable clamping slide adjustably mounted to said drawstring for forming a closed adjusting loop, said drawstring and said clamping slide cooperating to adjust the effective perimeter of said peripheral edge of said bottom portion of said shell defining a size of the headwear; and a retaining loop formed on an outer peripheral surface of said shell, wherein said portion of said drawstring passes beneath said retaining loop and forms said closed adjusting loop around said retaining loop.

3. The adjustable size headwear as defined in claim 2, wherein the headwear is a baseball cap.

4. An adjustable size headwear comprising a shell having a bottom portion defining an opening for reception of the head of a wearer, said bottom portion of said shell having a peripheral edge around said opening and said peripheral edge having an adjustable effective perimeter;

a size adjustment mechanism including a flexible drawstring slidably connected to said peripheral edge and a shiftable clamping slide adjustably mounted to said drawstring for forming a closed adjusting loop, said drawstring and said clamping slide cooperating to adjust the effective perimeter of said peripheral edge of said bottom portion of said shell defining a size of the headwear;

a visor affixed to said front portion of said shell along said peripheral edge and extending away therefrom, wherein said drawstring has two opposite ends operably attached to said visor.

* * * * *